US009803830B1

(12) United States Patent
Erickson et al.

(10) Patent No.: US 9,803,830 B1
(45) Date of Patent: Oct. 31, 2017

(54) MULTI-DIRECTIONAL LIGHTING WITH SINGLE ORIENTATION LIGHT SOURCE

(71) Applicant: Cooper Technologies Company, Houston, TX (US)

(72) Inventors: Joshua Richard Erickson, Lakewood, CO (US); Marc Raymond O'Leary, Aurora, CO (US)

(73) Assignee: Cooper Technologies Company, Houston, TX (US)

( * ) Notice: Subject to any disclaimer, the term of this patent is extended or adjusted under 35 U.S.C. 154(b) by 182 days.

(21) Appl. No.: 14/940,592

(22) Filed: Nov. 13, 2015

Related U.S. Application Data

(63) Continuation of application No. 14/137,546, filed on Dec. 20, 2013, now Pat. No. 9,200,782.

(60) Provisional application No. 61/745,326, filed on Dec. 21, 2012.

(51) Int. Cl.

| | |
|---|---|
| ***F21V 7/00*** | (2006.01) |
| ***F21K 99/00*** | (2016.01) |
| ***F21S 4/00*** | (2016.01) |
| *F21Y 103/00* | (2016.01) |

(52) U.S. Cl.
CPC ..... *F21V 7/0016* (2013.01); *F21K 9/175* (2013.01); *F21S 4/008* (2013.01); *F21Y 2103/003* (2013.01)

(58) Field of Classification Search
CPC ..... F21K 9/175; F21V 7/0016
See application file for complete search history.

(56) References Cited

U.S. PATENT DOCUMENTS

| | | | | |
|---|---|---|---|---|
| 6,558,032 | B2 | 5/2003 | Kondo et al. | |
| 7,473,007 | B1 | 1/2009 | Wang | |
| 8,425,085 | B2 * | 4/2013 | Van Laanen | F21V 3/02 362/218 |
| 2002/0105807 | A1 * | 8/2002 | Loughrey | F21S 8/02 362/278 |
| 2005/0162854 | A1 | 7/2005 | Finch | |
| 2008/0094842 | A1 | 4/2008 | King et al. | |
| 2011/0149585 | A1 | 6/2011 | Dubosc | |

* cited by examiner

*Primary Examiner* — Evan Dzierzynski
(74) *Attorney, Agent, or Firm* — King & Spalding LLP

(57) ABSTRACT

The present disclosure provides a multi-directional light fixture having a single orientation light source. The multi-directional light fixture includes a light source orientated towards a semi-reflective lens. The semi-reflective lens allows a portion of the light it receives from the light source to be reflected upwards, providing uplight from the light fixture. The lens also allows a portion of the light it receives from the light source to be transmitted therethrough, providing downlight from the light fixture. Thus, the light fixture provides both uplight and downlight while the light source is oriented downwards.

17 Claims, 4 Drawing Sheets

MULTI-DIRECTIONAL LIGHTING WITH SINGLE ORIENTATION LIGHT SOURCE

PRIORITY APPLICATION

This application is a continuation application of and claims priority under 35 U.S.C. §120 to U.S. patent application Ser. No. 14/137,546, titled "Multi-Directional Lighting with Single Orientation Light Source," filed on Dec. 20, 2013, which claims priority under 35 U.S.C. §119 to U.S. Provisional Patent Application No. 61/745,326 filed on Dec. 21, 2012 and titled "Multi-Directional Linear Lighting With A Point Light Source Utilizing Reflection and Lens Optical Design." The entire contents of the foregoing application are hereby incorporated by reference herein.

TECHNICAL FIELD

Embodiments of this disclosure relate generally to lighting solutions, and more particularly to a multi-directional light fixture.

BACKGROUND

Conventional multi-directional lighting solutions generally utilize fluorescent light tubes which give off light radially in many directions. Thus, uplight as well as downlight is provided. Recent light technology has seen a trend towards using LEDs as primary light sources due to their advantages such as increased energy efficiency, durability, and cost-effectiveness. However, LED's emit light in generally one direction range. Thus, LED-based multi-directional lighting solutions traditionally include two or more groups of LEDs aimed in different directions in order to generate multiple illumination zones. For example, one group of LEDs may be aimed downward to provide downlight and another group of LEDs may be aimed upward to provide uplight. Such solutions require an increased number of lights, which increases cost of manufacturing as well as heat generated at the light fixture.

SUMMARY

In an example embodiment of the present disclosure, a multi-directional light fixture includes a housing having a frame defining a first opening within the frame. The light fixture also includes a reflection pan disposed within the housing. The reflection pan includes a first reflection panel and a second reflection panel opposite the first reflection panel at an angle. A second opening is formed between the first and second reflection panels. The light fixture further includes a lens disposed over or within the first or second opening, and a mounting channel disposed above and supported from the frame. The mounting channel includes a downwardly directed light source, in which the light source emits light toward the lens and the first and second reflections panels. A first portion of the light emitted from the light source is transmitted downward through the lens, a second portion of the light emitted from the light source is reflected substantially upward by the lens, and a third portion of the light emitted from the light source is reflected substantially upward by the first and second reflection panels.

In another example embodiment of the present disclosure, a multi-directional light fixture includes a housing having a frame and a first opening formed within the frame. The light fixture also includes a lens disposed over or within the first or second opening, and a mounting channel disposed above the lens. The mounting channel comprises a downwardly directed light source, in which the light source emits light toward the lens. A first portion of the light emitted from the light source is transmitted through the lens. A second portion of the light emitted from the light source is reflected by the lens. The first portion of light illuminates a first area below the housing and the second portion of light illuminates a second area above the housing.

In another example embodiment of the present disclosure, a light fixture includes a housing comprising an opening formed therein, and a lens disposed within or over the opening. The lens transmits a first percentage of light it receives and reflects a second percentage of light it receives. The light fixture further includes a light source mounted above the lens and over the opening. The light source is configured to emit light directed substantially towards the lens, in which a first portion of the light emitted from the light source is transmitted through the lens, and a second portion of the light emitted from the light source is reflected by the lens.

BRIEF DESCRIPTION OF THE DRAWINGS

Reference will now be made to the accompanying drawings, which are not necessarily drawn to scale, and wherein.

DETAILED DESCRIPTION OF EXAMPLE EMBODIMENTS

Figure 1:
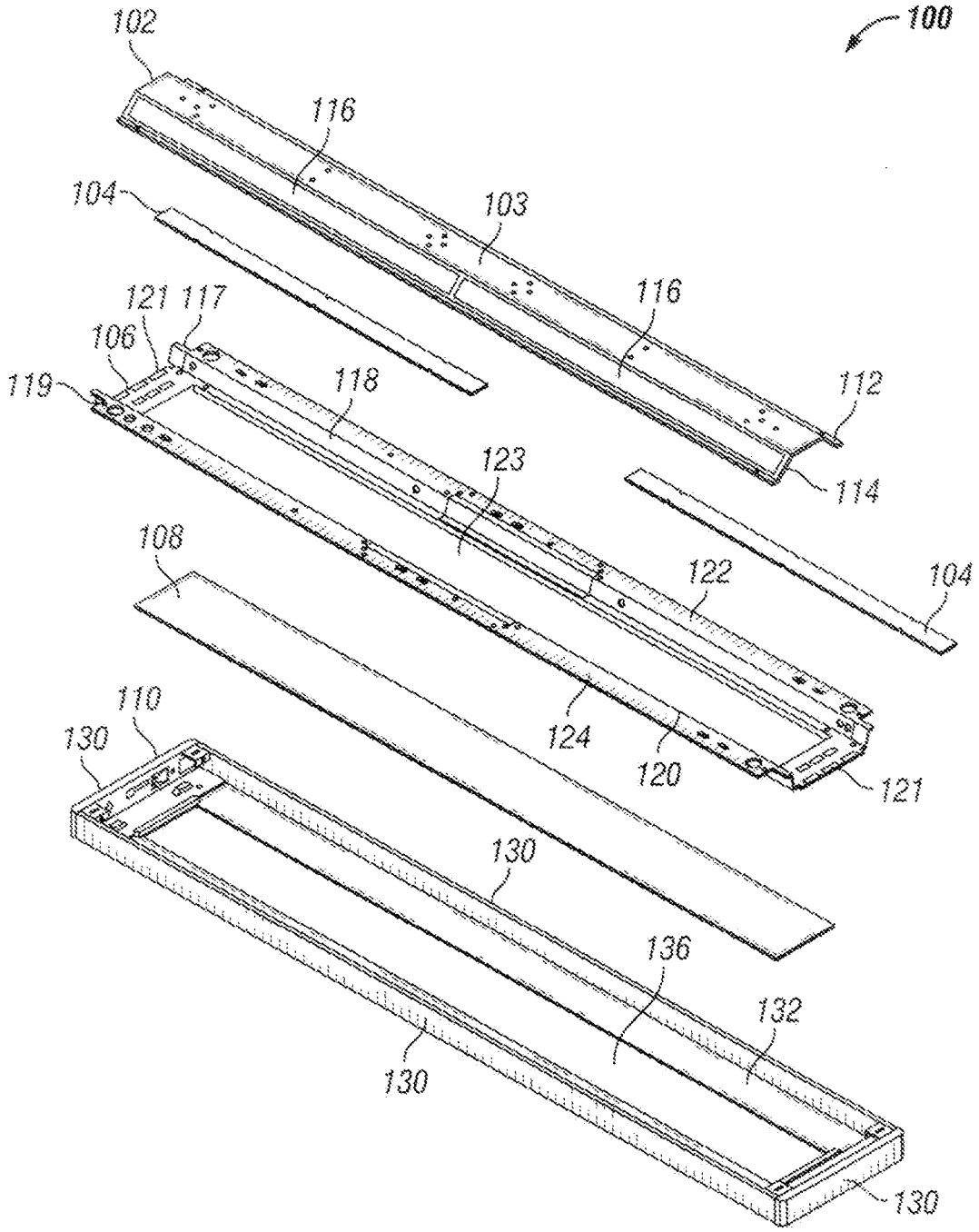
FIG. 1 is an exploded view of a multi-directional light fixture in accordance with an example embodiment.

The example embodiments discussed herein are directed to a multi-directional light fixture utilizing a single light source and reflection to generate multiple illumination zones. Although the description of example embodiments is provided below in conjunction with a linear light fixture, alternate example embodiments are applicable to other types of lighting solutions having multi-directional light, including other types of light fixtures known to people having ordinary skill in the art. Furthermore, while example embodiments described herein utilized LED strips as a light source, other example embodiments utilize alternate light sources, including point light sources. The example embodiments are better understood by reading the following description of non-limiting, example embodiments with reference to the attached drawings, wherein like parts of each of the figures are identified by like reference characters, and which are briefly described as follows.

Figure 3:
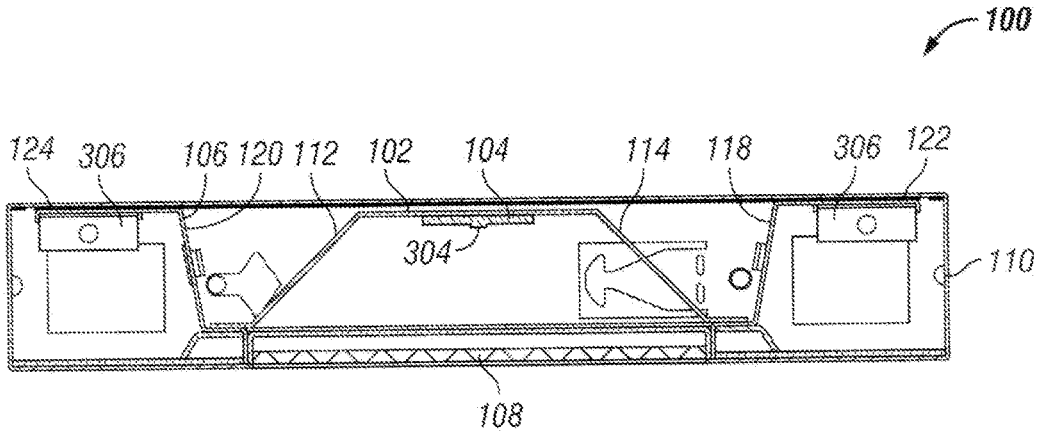
FIG. 3 is a cross-sectional view of the multi-directional light fixture of FIG. 1 in accordance with an example embodiment.

The present disclosure provides a multi-directional light fixture capable of providing illumination in multiple directions from one set of light sources. Turning to the figures, FIG. 1 is an exploded view of a multi-directional light fixture 100 in accordance with an example embodiment of the present disclosure. FIG. 3 is a cross-sectional view of the multi-directional light fixture of FIG. 1 in accordance with an example embodiment. Referring to FIGS. 1 and 3, the multi-directional light fixture 100 includes a mounting channel 102, one or more LED strips 104, a reflection pan 106, a lens 108, and a housing 110. In certain example embodiments, the housing 110 includes a rectangular bottom frame 132 and four walls 130 extending orthogonally from the respective outer edges of the bottom frame 110. The walls 130 make up an outer casing, or outer wall, of the housing 110. The bottom frame 132 includes an inner rectangular opening 136. The ratio of the size of the inner rectangular opening 136 to the size of the bottom frame 110 may vary between different embodiments of the present disclosure. In certain example embodiments, the lens 108 is rectangularly shaped and is at least as wide and at least as long as the inner rectangular opening 136 of the housing 110. Thus, when installed, the inner rectangular opening 136 of the housing 110 is either filled with or covered by the lens 108. For example, in one embodiment, the lens 108 is installed and fits within the opening 136 of the housing 110. In certain example embodiments, the lens 108 is at least one of a nano-prism lens, a refractive lens, a linear prismatic lens, a clear lens having an overlay, or a frosted lens. In certain example embodiments, the lens 108 transmits a portion of the light it receives and reflects a portion of the light it receives. Thus, the lens 108 of a particular embodiment is chosen at least in part based on the desired transmission to reflection ratio. For example, certain embodiments include lenses 108 providing between 7% to 25% light reflection and between 75% to 93% light transmission.

The reflection pan 106 includes a first bracket 117 and a second bracket 119. In certain example embodiments, the brackets 117, 119 are linearly shaped and are substantially as long as the length of the housing 110. The brackets are parallel to each other and connected by end brackets 121 at their ends, forming a rectangular shape and an opening 123 defined between the brackets 117, 119 and the end brackets 121. In certain example embodiments, the rectangular opening 123 is of similar size as the lens 108 such that the lens 108 may fit within the rectangular opening 123 when installed. In certain other embodiments, the lens 108 is adjacent to the rectangular opening 123. The first bracket 117 includes a first reflection panel 118 and a first mounting panel 122, in which the first reflection panel 118 is coupled to the first mounting panel 122 lengthwise at an angle. The second bracket 119 likewise includes a second reflection panel 120 and a second mounting panel 124, in which the second reflection panel 120 is coupled to the second mounting panel 124 lengthwise at an angle. The first and second reflection panels 118, 120 run along the length of the first and second brackets 117, 119, respectively and are disposed at mirroring obtuse angles with respect to the rectangular opening 123 or the lens 108 when installed, which can be best seen in FIG. 3. The reflection panels 118, 120 include reflective surfaces which reflect at least a portion of the light received. The first and second mounting panels 122, 124 likewise run along the length of the first and second brackets 117, 119. The mounting panels 122, 124 are disposed adjacent to the reflection panels 118, 120, respectively along their lengths and are parallel to the rectangular opening 123 or lens 108. When assembled, the mounting panels 122, 124 are disposed over corresponding support elements 306 on the housing 110. Thus, when fully disposed, the reflection pan 106 is disposed substantially within the housing 110. In certain example embodiments, when installed, the opening 123 is substantially aligned with and/or is of similar size as the opening 136 of the housing 110.

The mounting channel 102 includes a mounting bar 103 having a length substantially similar to that of the housing 110. The mounting channel 102 also includes a first support 112 and a second support 114 disposed along opposite sides of the mounting bar 103 and at a downward angle, as is best seen in FIG. 3. In certain example embodiments, the first and second supports 112, 114 each include a support frame defining large gap areas 116 through which light travels without obstruction. The mounting channel 102 is disposed substantially within the reflection pan 106 in which the supports 112, 114 rest on an inner surface 140 the housing 110 and support the mounting bar 103 above the lens 108. In certain example embodiments, the mounting bar 103 includes one or more orifices through which light can travel without obstruction. In certain example embodiments, the one or more LED strips 104 include one or more LEDs 304 facing away from the LED strip 104. In certain example embodiments, the one or more LED strips 104 are disposed on a bottom surface of the mounting bar 103 such that the LEDs 304 are directed downwards towards the lens 108. In certain example embodiments, the LED strips 104 have various numbers of LEDs 304 which can be arranged in various configurations, such as in rows, groups, another pattern, or randomly. In certain example embodiments, the LED strips 104 are attached to the mounting channel 102 via an adhesive, screws, clips, or the like. In certain other example embodiments, the LEDS 304 are mounted directly to the mounting channel 102. The LEDs 304 provide a downwardly directed source of light. Accordingly, the light from the LEDs 304 reaches the lens 108 and the reflection panels 118, 120. Thus, a portion of the light travels through the 108 and is seen as downlight provided downwardly from the multi-directional light fixture 100. In certain example embodiments, another portion of the light is reflected upward by the lens 108 and is provided as uplight directed upward from the multi-directional light fixture 100. In certain example embodiments, yet another portion of the light emitted from the LEDs is reflected upwardly at an angle by the reflection panels 118, 120.

As shown in FIG. 3, the reflection pan 106 and mounting channel 102 are symmetrically disposed within the housing 110 and between the walls 130 of the Houston 110. Specifically, in certain example embodiments, the mounting channel 102 is disposed between the brackets 117, 119 of the reflection pan 106. In certain example embodiments, the LED strips 104 are disposed to the underside 308 of the mounting channel 102 along a midline 310 of the mounting channel 102.

Figure 2:
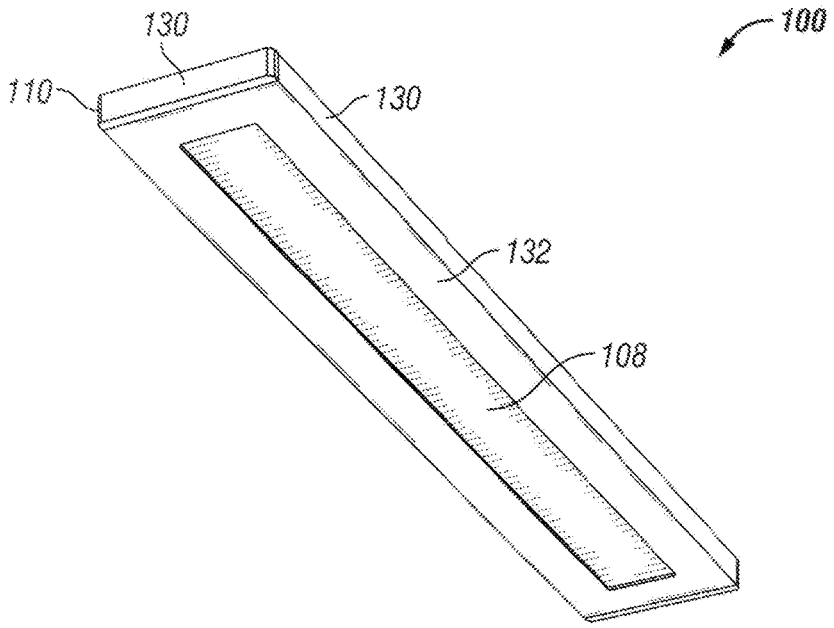
FIG. 2 is a bottom perspective view of the multi-directional light fixture of FIG. 1 in accordance with an example embodiment.

FIG. 2 is a bottom perspective view of the multi-directional light fixture 100 in which the housing 110, including the walls 130 and bottom frame 132, and the lens 108 can be seen. The reflection pan 106, LED strip 104, and mounting channel 102 are disposed within the housing 110 and thus, hidden from view. In certain example embodiments, the multi-directional light fixture 100 is suspended from a mounting structure such as a ceiling or beam with the bottom of the light fixture 100 directed downward. In certain example embodiment, such as illustrated in FIG. 2, the multi-directional light fixture 100 has an elongated rectangular shape. In certain other example embodiments, the multi-directional light fixture 100 takes on a square shape, circular shape, elliptical shape, polygonal shape, and other geometric and non-geometric shapes.

Figure 4:
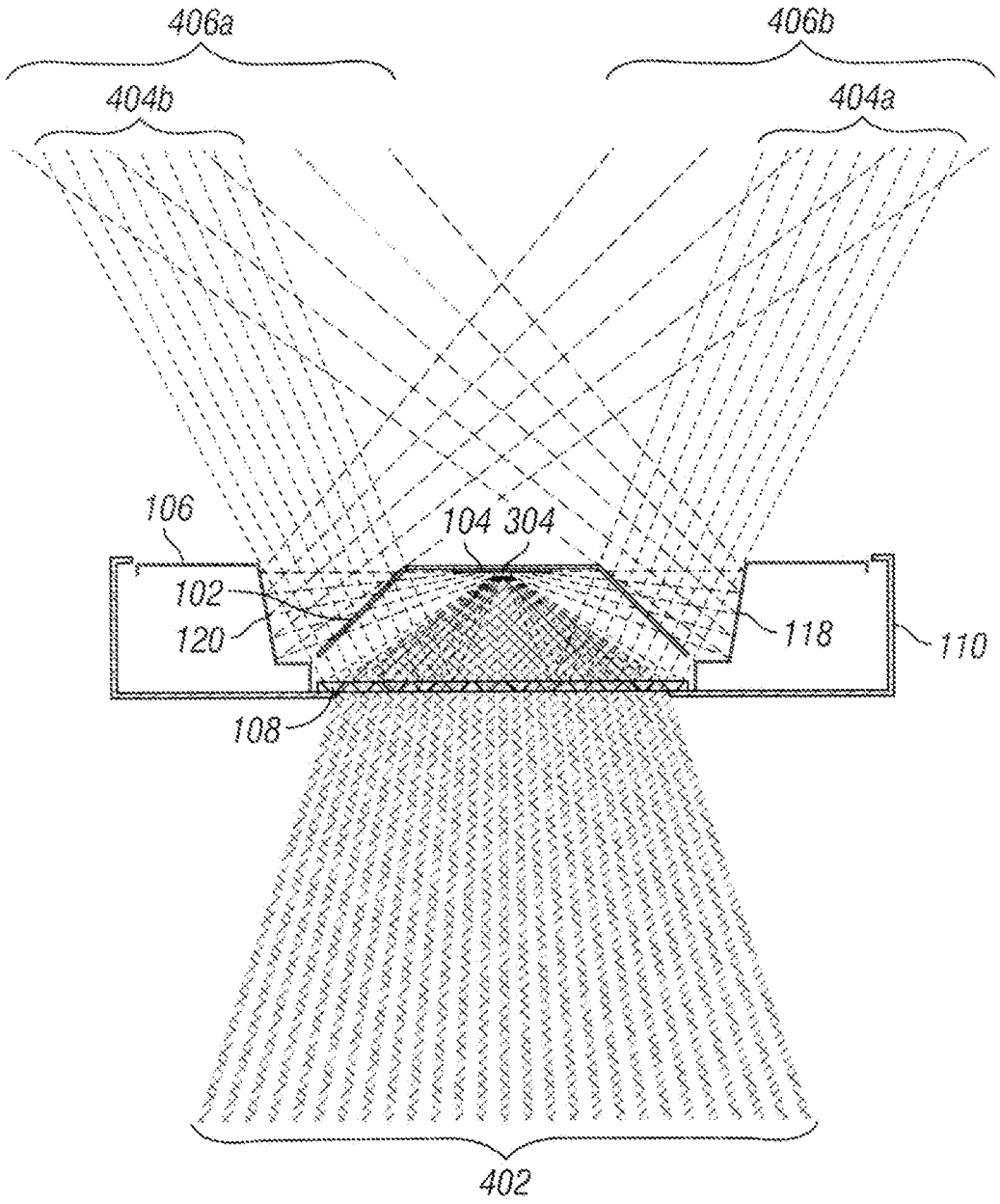
FIG. 4 is a cross-sectional view of the multi-directional light fixture of FIG. 1 showing multiple illumination zones in accordance with an example embodiment.

FIG. 4 is a cross-sectional view of the multi-directional light fixture of FIG. 1, showing multiple directions of illumination in accordance with example embodiments of the present disclosure. With the one or more LEDs 304 on the LED strip 104 being directed downward, a portion of the light emitted from the LEDs 304 is transmitted through the lens 108, forming an illumination zone A 402. Illumination zone A 402 is generally the downlight provided by the multi-directional light fixture 100. A portion of the light emitted from the LEDs 304 onto the lens is reflected upward when it reaches the lens 108. In certain example embodiments, the light reflected upward by the lens 108 is reflected at one or more upward angles, depending on the incidence angle of the light reaching the lens 108. As illustrated, the light reflected upward by the lens 108 generates an illumination zone B 404*a* and an illumination zone C 404*b*. In certain example embodiments, a portion of the light emitted sideways from the LEDs 304 reaches the first reflection panel 118 and is reflected upward at an angle, forming an illumination zone D 406*a*. Likewise, a portion of the light emitted sideways from the LEDs 304 reaches the second reflection panel 120 and is reflected upward at an angle in the opposite direction and forms an illumination zone E 406*b*. Thus, illumination zone B 404*a*, illumination zone C 404*c*, illumination zone D 406*a*, and illumination zone 406*b* form the uplight provided from the multi-directional light fixture 100. In certain other example embodiments, the angles of the reflection panels 118, 120 with respect to the LEDs 304 are varied, thereby varying the angle and direction of the light reflected by the reflection panels 118, 120. In certain example embodiments, various other specifications of the multi-directional light fixture 100 can be adjusted or changed to change the direction, intensity, or focus of the light provided therefrom. In the embodiment illustrated in FIGS. 1-4, the uplight is provided via reflections of downward and sideways light emitted from the LEDs 304. Thus, there is no need for an additional LED strip 104 or light source to be placed in the opposite direction to provide the uplight.

Figure 5:
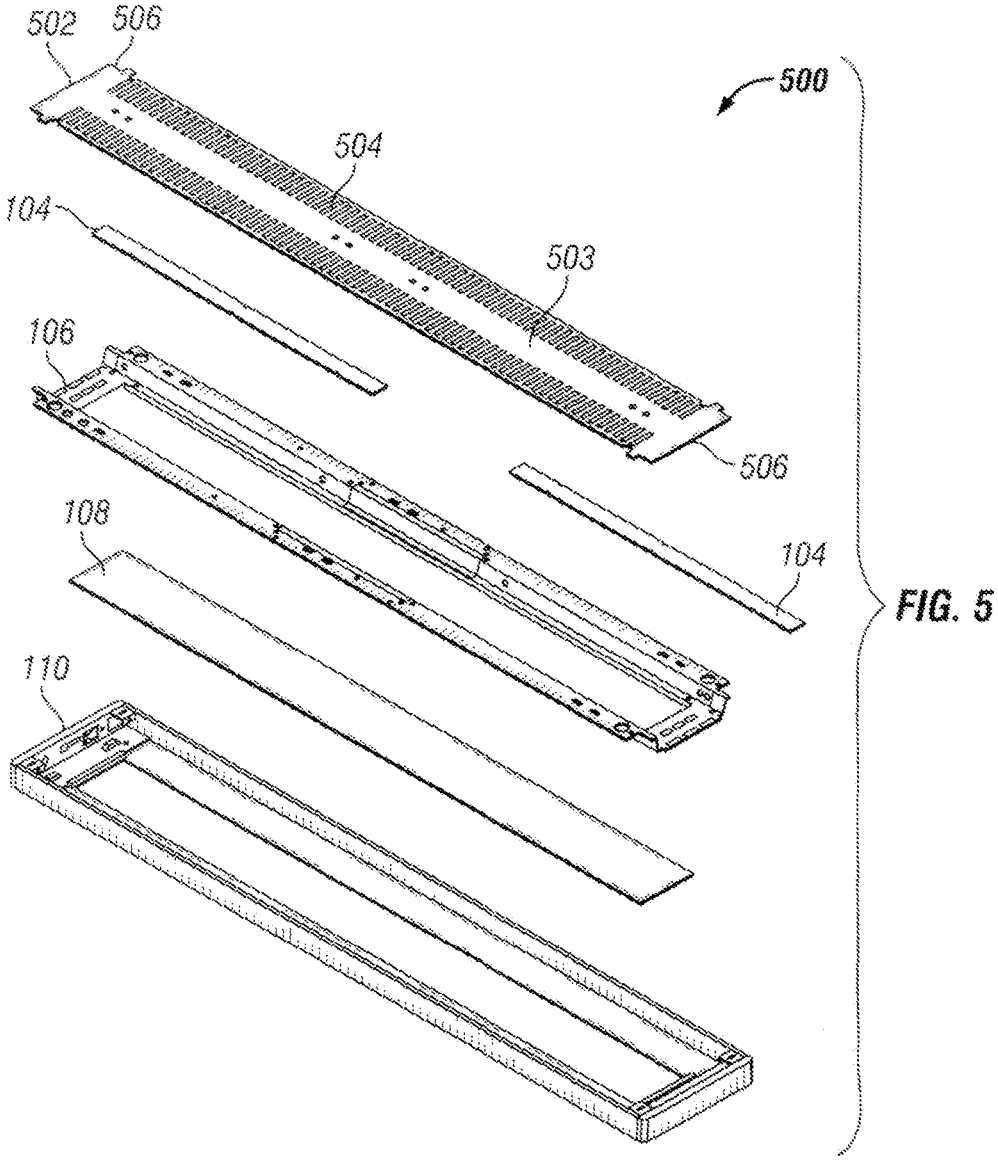
FIG. 5 is an exploded view of another embodiment of a multi-directional light fixture in accordance with an example embodiment.
Figure 6:
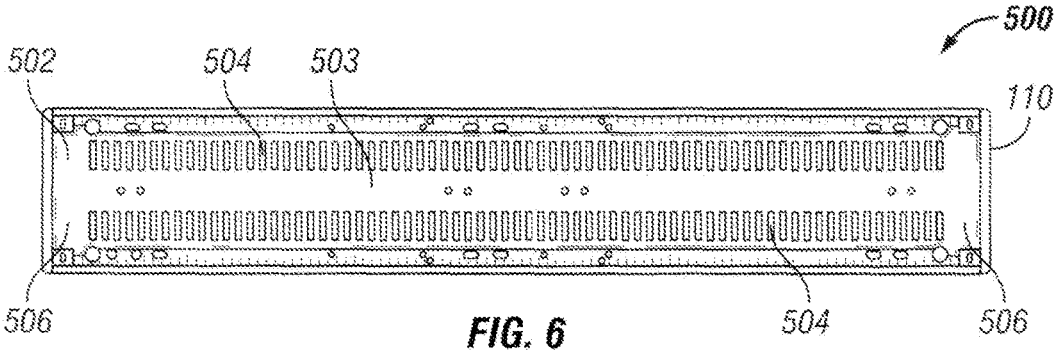
FIG. 6 is a top view of the multi-directional light fixture of FIG. 5 in accordance with an example embodiment.

FIG. 5 is an exploded view of another embodiment of a multi-directional light fixture 500 in accordance with an example embodiment of the present disclosure. FIG. 6 is a top view of the multi-directional light fixture 500 shown in FIG. 5 in accordance with an example embodiment. Referring to FIGS. 5 and 6, the multi-directional light fixture 500 is similar to the multi-directional light fixture 100 of FIG. 1 in that the multi-directional light fixture 500 also includes the housing 110, the lens 108, the reflection pan 106, and the one or more LED strips 104. However, in place of the mounting channel 102, the multi-directional light fixture 500 of FIG. 5 features a mounting pan 502. The mounting pan 502 is rectangular and has dimensions which allow it to fit within and be compatible with the housing 110. The mounting pan 502 includes a middle portion 503 which runs along the length of the mounting pan 502, and to which the one or more LED strips 104 are affixed. The mounting pan 502 also includes a plurality of open slots 504 or gaps on either side of the middle portion 503. The open slots 504 or gaps allow light that is reflected upward by either the lens 108 or the reflection pan 106 to exit the multi-directional light fixture 500, providing uplight. In certain example embodiments, the slots 504 of the mounting pan 502 can be configured to have different sizes and orientations, which allow varying amounts to light to exist the mounting pan 502. In certain example embodiments, the mounting pan 502 includes orifices of other shapes and configurations, which also allow light to exit the mounting pan 502. In certain example embodiments, the mounting pan 502 further includes mounting tabs 506 which are disposed at the ends of the mounting pan 502 and mounted on top of the reflection pan 106 or housing 110 to support the mounting pan 502. In certain embodiments, the multi-directional light fixture 500 provides uplight and downlight in a substantially similar pattern as shown in FIG. 4. In certain embodiments, the multi-directional light fixtures 100, 500 are configured to generate illumination patterns different than those described and shown herein.

It should be understood that the foregoing embodiments are non-limiting examples. In alternate embodiments, light sources other than LEDs can be used, particularly alternate point light sources. Additionally, in alternate embodiments the shape and configuration of the housing, lens and reflections can take other forms to provide light fixtures with shapes that are circular, triangular, square or other desired shapes.

What is claimed is:

1. A multi-directional light fixture, comprising:

a housing comprising a frame and defining a first opening within the frame;

a reflection pan disposed within the housing and comprising a first reflection panel and a second reflection panel opposite the first reflection panel at an angle; and a mounting channel disposed above and supported from the frame comprising a downwardly directed light source, wherein the light source emits light toward the first opening;

wherein a first portion of the light emitted from the light source is transmitted downward through the first opening, and a second portion of the light emitted from the light source is reflected substantially upward by the first and second reflection panels.

2. The multi-directional light fixture of claim 1, wherein the light source comprises one or more LEDs.

3. The multi-directional light fixture of claim 1, wherein the reflection pan further comprises a first mounting panel coupled to the first reflection panel and a second mounting panel coupled to the second reflection panel, the first and second mounting panels mounting the reflection pan in place within the housing.

4. The multi-directional light fixture of claim 1, wherein the mounting channel includes one or more support frames disposed at an angle on one or more sides of the mounting channel, wherein the one or more support frames are disposed on the frame of the housing and elevates the mounting channel above the first opening.

5. The multi-directional light fixture of claim 4, wherein the one or more support frames include a plurality of light transmissive openings.

6. The multi-directional light fixture of claim 2, wherein the LEDs are disposed on one or more LED strips mounted to the mounting channel.

7. A multi-directional light fixture, comprising:

a housing comprising a frame and an opening formed within the frame;

a reflection pan disposed within the housing and comprising a first reflection panel and a second reflection panel opposite the first reflection panel; and a mounting channel disposed above the opening and comprising a light source, wherein the light source emits light toward the opening;

wherein a first portion of the light emitted from the light source is transmitted through the opening, and a second portion of the light emitted from the light source is reflected by the first reflection panel, and a third portion of the light emitted from the light source is reflected by the second reflection panel, and wherein the first portion of light illuminates a first area below the housing and the second and third portions of light illuminates a second area above the housing.

8. The multi-directional light fixture of claim 7, wherein the reflection pan further comprises a first mounting panel coupled to the first reflection panel and a second mounting panel coupled to the second reflection panel, the first and second mounting panels mounting the reflection pan in place within the housing.

9. The multi-directional light fixture of claim 7, wherein the mounting channel includes one or more support frames disposed at an angle on one or more sides of the mounting channel, wherein the one or more support frames are disposed on the frame of the housing and elevates the mounting channel above the first opening.

10. The multi-directional light fixture of claim 7, wherein the mounting channel is disposed over the frame of the housing, wherein the mounting channel comprising a middle portion that runs along the length of the mounting channel, wherein the light source is coupled to the middle portion.

11. The multi-directional light fixture of claim 10, wherein the mounting channel comprises a plurality of open slots on either side of the middle portion formed therein, providing an exit for the second and third portions of light.

12. The multi-directional light fixture of claim 7, wherein the mounting channel comprises a first support frame coupled to a first side of the mounting channel at a first angle and a second support frame coupled to a second side of the mounting channel at a second angle, wherein the first and second support frames are disposed within the frame of the housing and elevate the mounting channel above the opening.

13. A light fixture, comprising:

a housing comprising an opening formed therein;

a reflection pan disposed within the housing and comprising a first reflection panel and a second reflection panel opposite the first reflection panel at an angle; and a light source mounted above the opening and over the opening, wherein the light source is configured to emit light directed substantially towards the opening, wherein a first portion of the light emitted from the light source is transmitted through the opening, and a second portion of the light emitted from the light source is reflected by the reflection panels of the reflection pan, wherein the first portion of the light illuminates a first area in a first direction of the housing and the second portion of the light illuminates a second area in a second direction of the housing, wherein the first direction is opposite the second direction.

14. The multi-directional light fixture of claim 13, wherein the reflection pan further comprises a first mounting panel coupled to the first reflection panel and a second mounting panel coupled to the second reflection panel, the first and second mounting panels mounting the reflection pan in place within the housing.

15. The multi-directional light fixture of claim 13, wherein light fixture comprises a mounting channel that is disposed over a frame of the housing, wherein the mounting channel comprising a middle portion that runs along the length of the mounting channel, wherein the light source is coupled to the middle portion.

16. The light fixture of claim 13, wherein the light source is mounted on a mounting channel, wherein the mounting channel is supported and elevated above the opening by a pair of support frames coupled to opposite sides of a mounting channel at an angle and disposed within the housing.

17. The light fixture of claim 13, wherein the light source is mounted on a mounting pan, wherein the mounting pan is disposed over the housing.

* * * * *